United States Patent [19]

Sato et al.

[11] 4,402,763

[45] Sep. 6, 1983

[54] HIGH CONDUCTIVE HEAT-RESISTANT ALUMINUM ALLOY

[75] Inventors: Kenichi Sato; Kazuhisa Yamauchi; Yasumasa Hanaki; Takasi Kondo; Minoru Yokota, all of Osaka, Japan

[73] Assignee: Sumitomo Electric Industries, Ltd., Osaka, Japan

[21] Appl. No.: 252,017

[22] Filed: Apr. 8, 1981

[30] Foreign Application Priority Data

Apr. 14, 1980 [JP] Japan ..... 55-49446

[51] Int. Cl.[3] ..... C22F 1/04

[52] U.S. Cl. ..... 148/2; 148/12.7 A; 148/415; 148/416; 148/417

[58] Field of Search ..... 148/2, 11.5 A, 12.7 A, 148/32, 32.5

[56] References Cited

U.S. PATENT DOCUMENTS 4,072,542 2/1978 Murakado et al. ..... 148/11.5 A

*Primary Examiner*—R. Dean

*Attorney, Agent, or Firm*—Wenderoth, Lind & Ponack

[57] ABSTRACT

A heat-resistant aluminum alloy for electrical use, having high heat resistance and conductivity, obtained by subjecting an Al-Zr alloy comprising 0.23–0.35% Zr, the balance consisting of ordinary impurities and aluminum, to melting, casting, hot rolling in the state of high temperature or continuous heating, cold working to a predetermined size, ageing at a temperature within the range of 310° C.–390° C. for 50–400 hours so that $Al_3Zr$ is dispersed uniformly and in fine particles, and, optionally, further cold working to a degree not exceeding 30% of reduction of area. The resultant aluminum alloy has conductivity in excess of 58% IACS, same strength as 1350 aluminum wire, and 10% softening temperature higher than 400° C. at one hour annealing.

10 Claims, No Drawings

HIGH CONDUCTIVE HEAT-RESISTANT ALUMINUM ALLOY

The invention relates to a heat-resistant aluminum alloy for electrical use, having high heat-resistance and conductivity.

Conventionally, an aluminum alloy having high heat-resistance and conductivity has been obtained by adding a small amount of zirconium (Zr) to aluminum and forming a solid solution of zirconium and aluminum in the course of the production. (For example, Japanese Patent Nos. 842110 and 842111)

Such heat-resistant aluminum alloy for electrical use is known as a 60% heat-resistant aluminum alloy (60 TAL) characterized by a conductivity higher than 60% IACS and heat resistance to a temperature of 150° C. during continuous use.

In recent years, there has been a strong demand for improved heat resistance of the heat-resistant aluminum alloy for electrical use, thereby enabling an increase in the conduction capacity of the wire of the same size.

The present invention has been accomplished as a result of a series of experiments by the inventors on various alloys in order to improve the aforementioned heat resistance of the heat-resistant aluminum alloy for electrical use. The invention has for an object to provide a heat-resistant aluminum alloy for electrical use having high conductivity in excess of 58% IACS and far greater heat resistance than that of the conventional aluminum alloy.

According to the invention, an Al-Zr alloy comprising 0.23–0.35% Zr, the balance consisting of ordinary impurities and aluminum, is melted and cast, and the ingot is hot rolled in the state of high temperature or continuous heating, cold worked to a predetermined size, subjected to ageing within a temperature range of 310°–390° C. for 50–400 hours so that $Al_3Zr$ is uniformly dispersed in fine particles, and subjected to further cold processing not exceeding 30% of reduction of area, thereby obtaining a high heat-resistant aluminum alloy for electrical use characterized in that it has conductivity in excess of 58% IACS, same strength as that of 1350 aluminum wire, and 10% softening temperature in excess of 400° C. at one hour annealing. Said 10% softening temperature means the lowest heating temperature at which the tensile strength is reduced by 10% by heating for one hour.

According to the invention, the amount of Zr is prescribed as 0.23–0.35% for the following reasons. If said amount is less than 0.23%, heat resistance is insufficient, while if in excess of 0.35%, not only is the cost increased, but there arises coarsening of the precipitates thereby reducing the heat resistance in inverse proportion to the increase in the amount of Zr. The ageing conditions after the cold working are prescribed such that the temperature should be within the range of 310°–390° C. for 50–400 hours for the following reasons. By the heat treatment Zr is finely precipitated as $Al_3Zr$ thereby enabling improvement of the conductivity, while the forced dispersion of the finely precipitated $Al_3Zr$ enables an increase in the heat resistance. If the temperature is lower than 310° C., the heat treatment is prolonged whereby the productivity is impaired, while if the temperature is in excess of 390° C., the precipitates are coarsened thereby deteriorating the heat resistance. The time and temperature in the ageing treatment are correlative to each other under the optimum conditions.

In proportion, as the temperature is higher, the treating time can be shorter. As far as the industrial production is concerned, however, the time and temperature necessary to obtain uniform properties should be selected in conformity with the size of the alloy to be heated and the kind of the furnace to be used. If the time is shorter than 50 hours, the conductivity and heat resistance are not sufficiently improved, while if in excess of 400 hours, the improvement of the properties reaches saturation.

According to the invention, further cold processing not exceeding 30% of reduction of area is applied after the ageing treatment, if necessary, for the following reasons. When a heat-resistant Al-Zr alloy is subjected to ageing while having a size substantially the same as the size in which it will be used, precipitates of $Al_3Zr$ are dispersed in fine particles, while conductivity is synchronously improved. When an alloy larger than the size at which it will be used is subjected to ageing, for example, after hot rolling, a far longer time is necessitated to obtain the same conductivity, while the heat resistance, which is most important, is deteriorated. However, if the cold working after ageing is less than 30% of reduction of area, the early strength can be increased without sacrificing the conductivity and heat resistance.

According to the invention, the casting apparatus may be of the continuous casting and rolling system or the semi-continuous casting system. The temperature of the molten alloy (casting temperature) directly before casting is preferably at least 700° C. for the following reasons. When the concentration of Zr is high as in the case of the invention, Zr is precipitated in the form of coarse particles of $Al_3Zr$ if the casting temperature is lower than 700° C., whereby the amount of Zr otherwise capable of exhibiting the effect of heat resistance is decreased, while at the same time the precipitated coarse particles reduce the heat resistance.

According to the invention, the alloy is hot rolled in the state of high temperature or continuous heating after casting in order to precipitate Zr uniformly and in fine particles during the ageing treatment by preventing its precipitation in the course of the hot rolling.

If there is a risk of the ingot being over-cooled due to spontaneous cooling before the commencement of rolling, it may be continuously heated by means of, for example, a tubular furnace, if necessary.

The temperature of the ingot directly before hot rolling (hot rolling starting temperature) is preferably at least 530° C. If the temperature is lower than 530° C., the heat resistance is reduced. The mechanism of deteriorating the heat resistance may be analyzed as follows. If the hot rolling starting temperature is low, the temperature of Al during the hot rolling is reduced, and accordingly, the conditions are not suitable for precipitation of Zr from the solid solution to elevate the conductivity of the wire rod after hot rolling. In the subsequent drawing process, however, heavy dislocations are accumulated near the precipitates, whereby precipitation of Zr still remaining in the solid solution is very uneven during ageing while in the size of use or a size similar thereto. This is presumably the reason why sufficient heat resistance is unobtainable.

In the invention, therefore, the alloy should have uniform dislocations when in the size of use or in a similar size, that is, in the size when the alloy is subjected to ageing.

The amount of Zr is preferably 0.25–0.30% if greater heat resistance is required, for example, if 10% softening temperature is to be elevated to 420° C. and upward. If it is less than 0.25%, satisfactory heat resistance is unobtainable, while if in excess of 0.30%, the precipitations are coarsened thereby reducing the heat resistance.

In the invention, if Cu is added to the Al-Zr alloy in the amount of 0.01–0.20%, the heat resistance and strength of the alloy can be increased. However, if the amount is less than 0.1%, neither the heat resistance nor the strength is improved, while if in excess of 0.20%, not only is the conductivity lowered but also the corrosion resistance is deteriorated. The amount added, therefore, should be not greater than 0.20%.

If Mg is added to the Al-Zr alloy in the amount of 0.01–0.25%, the strength of the alloy can be increased. However, if the amount is less than 0.01%, the strength is not improved, while if in excess of 0.25%, not only is the conductivity greatly reduced but also the heat resistance is decreased. The amount added, therefore, should be not greater than 0.25%.

The strength and heat resistance of the Al-Zr alloy according to the invention can be improved by adding 0.01–0.20% of Cu and Mg in total. If the amount added is less than 0.01%, no satisfactory effect is obtainable, while if in excess of 0.20%, the conductivity is greatly impaired. The total amount added, therefore, should be not greater than 0.20%.

In the invention, electrical grade aluminum can be used as raw material. It is preferable, however, that Fe and Si are less than 0.17% and 0.07% respectively in view of higher heat resistance. The properties, particularly in respect of heat resistance, can be improved by reducing Si below 0.07%. If Si is in excess of 0.10%, which is the maximum value in the case of electrical grade aluminum, the heat resistance is reduced. The invention will hereinunder be described in detail in reference to the following examples.

EXAMPLE 1

Alloys having the compositions as shown in Table 1 were melted by making use of electrical grade aluminum (JIS H2110), Al-5%Zr, Al-5%Cu mother alloy and pure Mg, and continuously cast by means of a machine of the rotary wheel type having a sectional area of 3200 mm to obtain cast bars. Said cast bars were immediately subjected to hot rolling to obtain wire rods of 9.5 mmϕ. The molten metal temperature (casting temperature) directly before casting was 705°–725° C., while the cast bar temperature (rolling starting temperature) was controlled between 540° and 590° C.

Then the wire rods of 9.5 mmϕ were subjected to drawing by a continuous drawing machine to obtain wires of 4.0 mmϕ.

The 4.0 mmϕ wires were heat treated under various ageing conditions as shown in Table 1 to obtain aluminum alloy wires according to the invention.

The tensile strength, conductivity and 10% softening temperature of each wire thus obtained are as shown in Table 1. By way of comparison, the physical properties of the conventional 1350 aluminium wire are also shown in Table 1.

TABLE 1

| Classification | Sample No | Chemical Composition (%) Zr | Cu | Mg | Si | Ageing Conditions Temperature (°C.) | Time (hr) | Properties of 4.0 mm ϕ Tensile Strength (kg/mm²) | Conductivity (% IACS) | 10% Softening Temperature (°C.) |
|---|---|---|---|---|---|---|---|---|---|---|
| Alloys of Invention | 1 | 0.24 | — | — | 0.05 | 350 | 100 | 17.2 | 59.8 | 415 |
| | 2 | 0.27 | — | — | 0.03 | 350 | 125 | 17.3 | 59.7 | 420 |
| | 3 | 0.29 | — | — | 0.03 | 325 | 250 | 17.5 | 60.0 | 435 |
| | 4 | 0.33 | — | — | 0.04 | 375 | 75 | 16.5 | 60.1 | 405 |
| | 5 | 0.27 | 0.05 | — | 0.03 | 340 | 150 | 17.9 | 59.9 | 425 |
| | 6 | 0.29 | 0.14 | — | 0.03 | 340 | 150 | 18.2 | 59.3 | 430 |
| | 7 | 0.25 | — | 0.04 | 0.03 | 325 | 200 | 17.6 | 59.8 | 425 |
| | 8 | 0.27 | — | 0.13 | 0.03 | 325 | 200 | 17.9 | 59.4 | 425 |
| | 9 | 0.27 | — | 0.24 | 0.03 | 315 | 275 | 18.2 | 58.7 | 425 |
| | 10 | 0.27 | 0.09 | 0.07 | 0.03 | 315 | 275 | 18.4 | 58.9 | 425 |
| | 11 | 0.26 | 0.04 | 0.03 | 0.03 | 315 | 250 | 18.0 | 59.5 | 420 |
| Conventional Alloy (1350) | 12 | — | — | — | 0.08 | — | — | 17.8 | 61.8 | 125 |

Table 1 shows that the Al-Zr alloy wires according to the invention have the same strength as conventional 1350 aluminum wire, while their conductivity and heat resistance are higher than 58% IACS and 400° C. respectively.

EXAMPLE 2

An Al-Zr alloy of the same composition as that of No. 2 in Table 1 was subjected to drawing up to 4.0 mmϕ with the casting temperature and rolling starting temperature varied as shown in Table 2, and the other conditions as per Example 1.

The 4.0 mmϕ wires thus obtained were subjected to ageing at 325° C. for 200 hours to produce aluminum alloy wires. The tensile strength, conductivity and 10% softening temperature of the wires thus obtained were as shown in Table 2.

TABLE 2

| Sample No. | Casting Temperature (°C.) | Rolling Starting Temperature (°C.) | Properties of 4.0 mm ϕ Tensile Strength (Kg/mm²) | Conductivity (% IACS) | 10% Softening Temperature (°C.) |
|---|---|---|---|---|---|
| 2a | 740 | 580 | 17.3 | 59.7 | 430 |
| 2b | 740 | 550 | 17.3 | 59.8 | 430 |
| 2c | 725 | 550 | 17.3 | 59.6 | 430 |
| 2d | 725 | 530 | 17.2 | 59.8 | 420 |
| 2e | 705 | 540 | 17.3 | 59.7 | 425 |
| 2f | 705 | 520 | 17.1 | 60.0 | 400 |
| 2g | 685 | 540 | 16.9 | 60.2 | 400 |
| 2h | 685 | 470 | 16.7 | 60.2 | 370 |

As Table 2 shows, alloy wires capable of sufficiently satisfying the condition of heat resistance at 400° C. can be obtained from 2a,2b,2c,2d and 2e which satisfy the two conditions of the casting temperature of at least 700° C. and the rolling starting temperature of at least 350° C., respectively.

Even when one of said two conditions is unsatisfied, if the deviation is relatively small, as in the case of the samples 2f and 2g, heat resistance of about 400° C. is obtainable. In this case, however, it is impossible to obtain sufficiently satisfactory physical properties for industrial production. Samples 2h which fails to satisfy the two conditions has very low heat resistance.

EXAMPLE 3

No. 4 (Table 1) aged aluminum wire 4.0 mmϕ produced in Example 1 was subjected to various degrees of cold roll working as shown in Table 3.

The tensile strength and 10% softening temperature of each of the wires thus obtained were as shown in Table 3.

TABLE 3

| Sample No. | Reduction of Area (%) | Tensile Strength (kg/mm$^2$) | 10% Softening Temperature (°C.) |
|---|---|---|---|
| 4a | 0 | 17.3 | 420 |
| 4b | 10 | 17.6 | 410 |
| 4c | 20 | 18.0 | 405 |
| 4d | 30 | 18.3 | 400 |
| 4e | 40 | 18.6 | 390 |
| 4f | 50 | 19.1 | 370 |

Table 3 shows that in proportion to the incerease in the degree of cold roll working, the heat resistance is deteriorated though the tensile strength is improved. It shows that heat resistance higher than 400° C. is maintainable if the processing degree is less than 30% of reduction of area.

EXAMPLE 4

Al-Zr alloys of the compositions as shown in Table 4 with the concentration of Si varied respectively were cast, rolled and drawn under the same conditions as in Example 1 to produce 4.0 mmϕ wires. The 4.0 mmϕ wires were subjected to the ageing treatment as shown in Table 4 to produce aluminum alloy wires.

The tensile strength, conductivity and 10% softening temperature of the wires thus obtained were as shown in Table 4.

TABLE 4

| Sample No. | Chemical Composition (%) Zr | Si | Ageing Temperature (°C.) | Time (hr) | Properties of 4.0 mm ϕ Tensile Strength (kg/mm$^2$) | Conductivity (% IACS) | 10% Softening Temperature (°C.) |
|---|---|---|---|---|---|---|---|
| 13 | 0.27 | 0.03 | 350 | 125 | 17.3 | 59.7 | 420 |
| 14 | 0.23 | 0.07 | 350 | 125 | 17.5 | 60.0 | 405 |
| 15 | 0.27 | 0.11 | 350 | 125 | 17.6 | 60.0 | 395 |
| 16 | 0.27 | 0.15 | 350 | 125 | 17.4 | 59.6 | 370 |

As Table 4 shows, in conformity with the increase of the amount of Si, the heat resistance deteriorates until it drops below 400° C. when the amount of Si exceeds 0.10% which is the maximum value of Si of electrical grade aluminum.

According to the invention, as described hereinabove, an Al-Zr alloy comprising 0.23–0.35% Zr, the balance consisting of ordinary impurities and aluminum, is melted, cast, hot rolled and cold worked and then subjected to ageing at a temperature within the range of 310°–390° C. for 50–400 hours in order to disperse $Al_3Zr$ uniformly and in fine particles, thereby enabling improved conductivity and greatly increased heat resistance due to intensified dispersion of $Al_3Zr$ precipitated in fine particles. Thus the invention has an advantage in that it enables production of aluminum alloy having high conductivity, and heat resistance such that the 10% softening temperature is at least 400° C., with the strength being the same as that of the conventional 1350 aluminum wire, though the conductivity is at least 58% IACS. Thus the heat resistant aluminum alloy wire according to the invention, when used in ACSR of the conventional size, can remarkably increase the capacity of current. The invention, therefore, has a great industrial value.

What is claimed is:

1. A process for producing an aluminum alloy having an electrical conductivity in excess of 58% IACS and a 10% softening temperature of at least 400° C., which process comprises providing a molten Al-Zr alloy consisting essentially of 0.23–0.35% Zr and the balance consisting essentially of aluminum, casting the molten Al-Zr alloy, hot rolling the cast alloy at a starting temperature of at least 530° C., cold working the rolled alloy, and ageing the cold worked alloy at 310°–390° C. for 50–400 hours.

2. A process as defined in claim 1, further comprising cold working the aged alloy at a reduction in area not exceeding 30%.

3. An aluminum alloy obtained by a process which comprises providing a molten Al-Zr alloy consisting essentially of 0.23–0.35% Zr and the balance consisting essentially of aluminum, casting the molten Al-Zr alloy, hot rolling the cast alloy at a starting temperature of at least 530° C., cold working the rolled alloy, and ageing the cold worked alloy at 310°–390° C. for 50–400 hours, said aluminum alloy having an electrical conductivity in excess of 58% IACS and a 10% softening temperature of at least 400° C.

4. An aluminum alloy as defined in claim 3 wherein said process further comprises cold working the aged alloy at a reduction in area not exceeding 30%.

5. An aluminum alloy as defined in claim 3 wherein the Al-Zr alloy contains 0.25–0.30% Zr, and the 10% softening temperature of the aluminum alloy is at least 420° C.

6. An aluminum alloy as defined in claim 3 wherein casting is effected at a casting temperature of at least 700° C.

7. An aluminum alloy as defined in claim 3 wherein the Al-Zr alloy further contains 0.01–0.20% Cu.

8. An aluminum alloy as defined in claim 3 wherein the Al-Zr alloy further contains 0.01–0.25% Mg.

9. An aluminum alloy as defined in claim 3 wherein the Al-Zr alloy further contains 0.01–0.20% Cu and Mg in total.

10. An aluminum alloy as defined in claim 3 wherein, among the ordinary impurities in the Al-Zr alloy, Si is less than 0.07%.

* * * * *